United States Patent [19]

Baker et al.

[11] 4,245,759

[45] Jan. 20, 1981

[54] ADHESIVE HAND GUN WITH SWIVEL CONNECTOR AND SAFETY MECHANISM

[75] Inventors: Robert G. Baker, Avon; Paul S. Frates, Brunswick; Jeffrey E. Morgan, Elyria, all of Ohio

[73] Assignee: Nordson Corporation, Amherst, Ohio

[21] Appl. No.: 35,311

[22] Filed: May 2, 1979

[51] Int. Cl.[3] ..... B67D 5/62

[52] U.S. Cl. ..... 222/146 HE; 219/230; 222/153; 222/323; 222/473

[58] Field of Search ..... 222/41, 43, 146 R, 146 H, 222/146 HE, 153, 191, 309, 323, 324, 473, 474; 251/285; 219/230, 236, 421, 533; 239/133-135, 526; 228/52, 53; 42/1 A, 70 E

[56] References Cited

U.S. PATENT DOCUMENTS

| | | | |
|---|---|---|---|
| 3,543,968 | 12/1970 | Reighand et al. | 222/146 R |
| 3,971,492 | 7/1976 | Lockwood | 222/323 X |
| 4,002,101 | 1/1977 | Tellie | 42/70 E X |
| 4,006,845 | 2/1977 | Scholl et al. | 222/146 HE |
| 4,099,653 | 7/1978 | Scholl et al. | 222/146 HE |
| 4,142,654 | 3/1979 | Doubleday et al. | 222/309 |

*Primary Examiner*—Robert J. Spar
*Assistant Examiner*—Fred A. Silverberg
*Attorney, Agent, or Firm*—Wood, Herron & Evans

[57] ABSTRACT

A hand held adhesive dispensing gun of the type intended to be rotatably mounted at the end of a heated flexible hose through which adhesive is supplied to the gun. The gun body includes a pivot post extending outwardly from the gun barrel. This post is pivotally mounted within a heated pivot sleeve which extends for approximately the full length of the post. Heat imparted to the sleeve by an electrical resistance heater mounted therein maintains the adhesive in the post and the gun barrel in the molten state. The design is such that there is no need for an electrical resistance heater in the rotatable gun and thus no need for an electrical cord to extend between the rotatable gun and the non-rotatable flexible hose.

14 Claims, 4 Drawing Figures

ADHESIVE HAND GUN WITH SWIVEL CONNECTOR AND SAFETY MECHANISM

BACKGROUND OF THE INVENTION

This invention relates to hand guns for applying hot melt adhesive to a work surface.

At the present time there are available many different types of hand guns for supplying adhesive to a substrate. Some of these hand guns use solid cartridges or flexible ribbons of adhesive which is melted within the gun and dispensed from it. U.S. Pat. Nos. 3,587,930 and 3,281,576 are typical of these types of guns. In general, these cartridge or ribbon type of hand guns are suitable for applications which require small amounts of adhesive. For many hot melt applications though which require melting large amounts of hot melt material they are not satisfactory. Such relatively heavy duty work generally employs a pressurized source of molten material from which the material is supplied in liquid or molten form to the hand gun through a heated flexible hose. The heated flexible hose or conduit through which the adhesive is supplied is very stiff, heavy, and difficult to manipulate. Consequently, it is customary with such hose fed guns to rotatably mount the hand gun or dispenser upon the end of the hose and to connect the gun to the hose through the handle or through a conduit which enters the gun forwardly of the handle. U.S. Pat. No. 3,543,968 illustrates a typical gun in which hot melt adhesive is fed from a hose through the handle of the gun. U.S. Pat. Nos. 3,971,492 and 4,006,845 illustrate other guns in which the hose fed adhesive is fed from beneath the gun through a conduit spaced forwardly of the handle of the gun.

All of the hose fed hand guns of which we are aware require heaters to be mounted on the body of the gun so as to maintain the molten adhesive in the molten state within the gun. In the absence of any such heaters the adhesive would cool within the gun barrel and clog the gun. Those heaters require an electrical connection or electrical lead between the flexible hose and the heater of the gun. Those electrical leads or cords though extending between the non-rotatable flexible hose and the rotatable hand gun are subject to being damaged and in any event inhibit the rotary motion of the gun.

The prior art hose fed hand guns of which we are aware are also subject to criticism because of the difficulty of rotating the guns relative to the flexible hoses to which they are connected. The swivel design between the guns and the flexible hoses has heretofore been characterized by a very high friction component or drag between the gun and the flexible hose. This drag contributes materially to operator fatigue and inhibits use of the gun.

BRIEF DESCRIPTION OF THE INVENTION

The invention of this application overcomes these difficulties and objections by providing a hand gun structure in which the electrical cord or lead between the hand gun heater and the electrical leads contained within the flexible hose is eliminated. Elimination of this lead or cord enables the hand gun to be freely pivoted and rotated through more than one full revolution in a single direction and additionally eliminates the problem of the cord becoming damaged and destroying the utility of the gun until the cord is repaired.

To eliminate the electrical cord or lead between the gun and the electrical lead of the flexible hose, the invention of this application supplies the molten adhesive from the flexible hose into a post of the gun body located forwardly of the gun handle. This post is pivotally mounted within a heated pivot sleeve which is in turn fixedly attached to the flexible hose. Adhesive is maintained in a molten state within the gun by an electrical resistance heater contained within the non-rotatable pivot sleeve. The pivot sleeve transmits heat from the resistance heater into the post of the gun body which is sufficiently close to the gun nozzle that it maintains all of the molten adhesive in the gun and nozzle in the liquid state. Because the pivot sleeve is fixed relative to the hose there is no problem with the electrical cord between the heater and the flexible hose winding about the post as the gun is rotated relative to the hose, and consequently the electrical cord is not subject to being damaged by such rotation or over-rotation.

The gun of this invention incorporates an improved thrust bearing between the gun body post and the pivot sleeve within which the post is mounted. This thrust bearing includes a ball thrust bearing which so reduces friction between the two that the gun may be easily manipulated without operator fatigue of the type which has heretofore inhibited use of hose fed hot melt hand guns.

These and other objects and advantages of this invention will be more readily apparent from the following description of the drawings in which.

Figure 1:
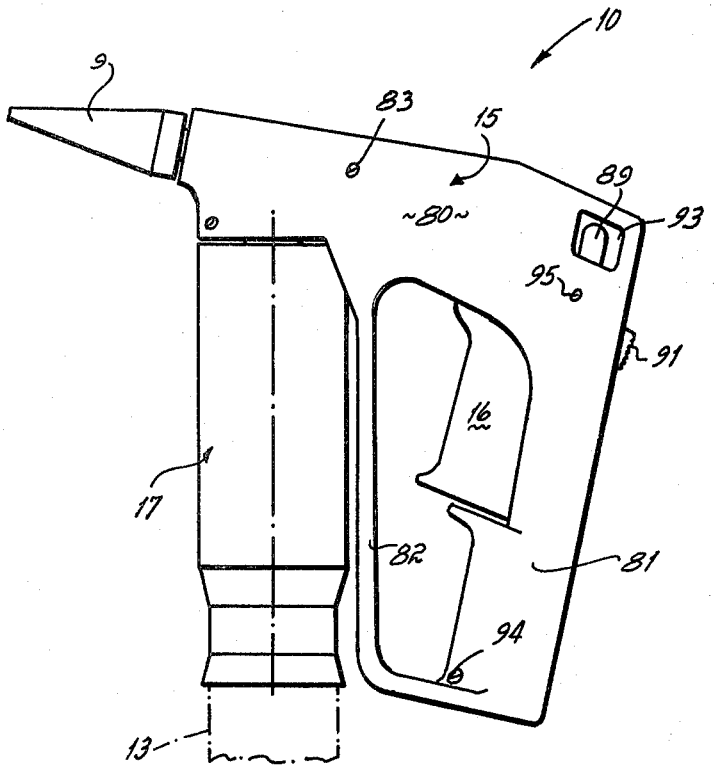
FIG. 1 is a side elevational view of a hand gun incorporating the invention of this application.
Figure 4:
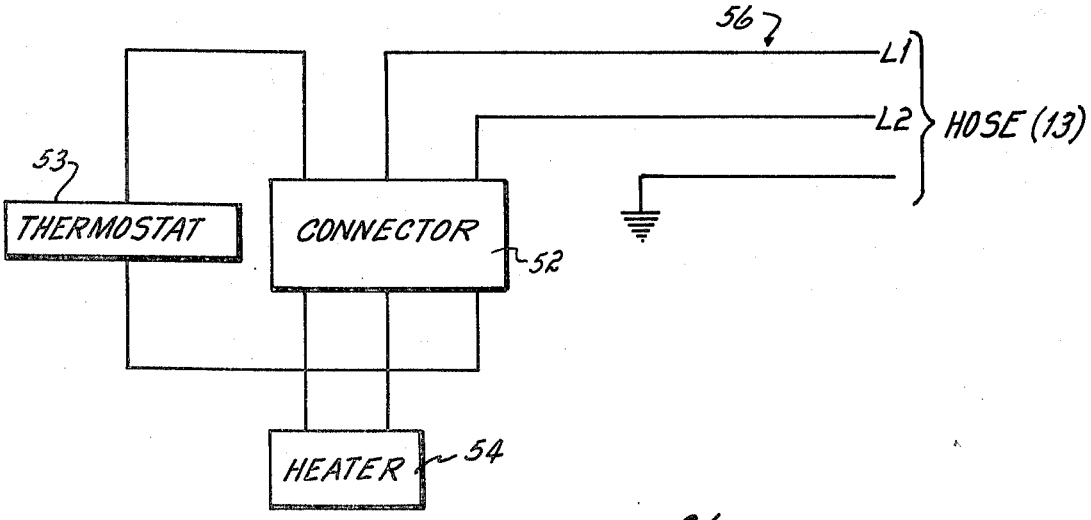
FIG. 4 is a diagrammatic illustration of the electrical circuit employed in the hot melt hand gun of FIGS. 1–3.
Figure 2:
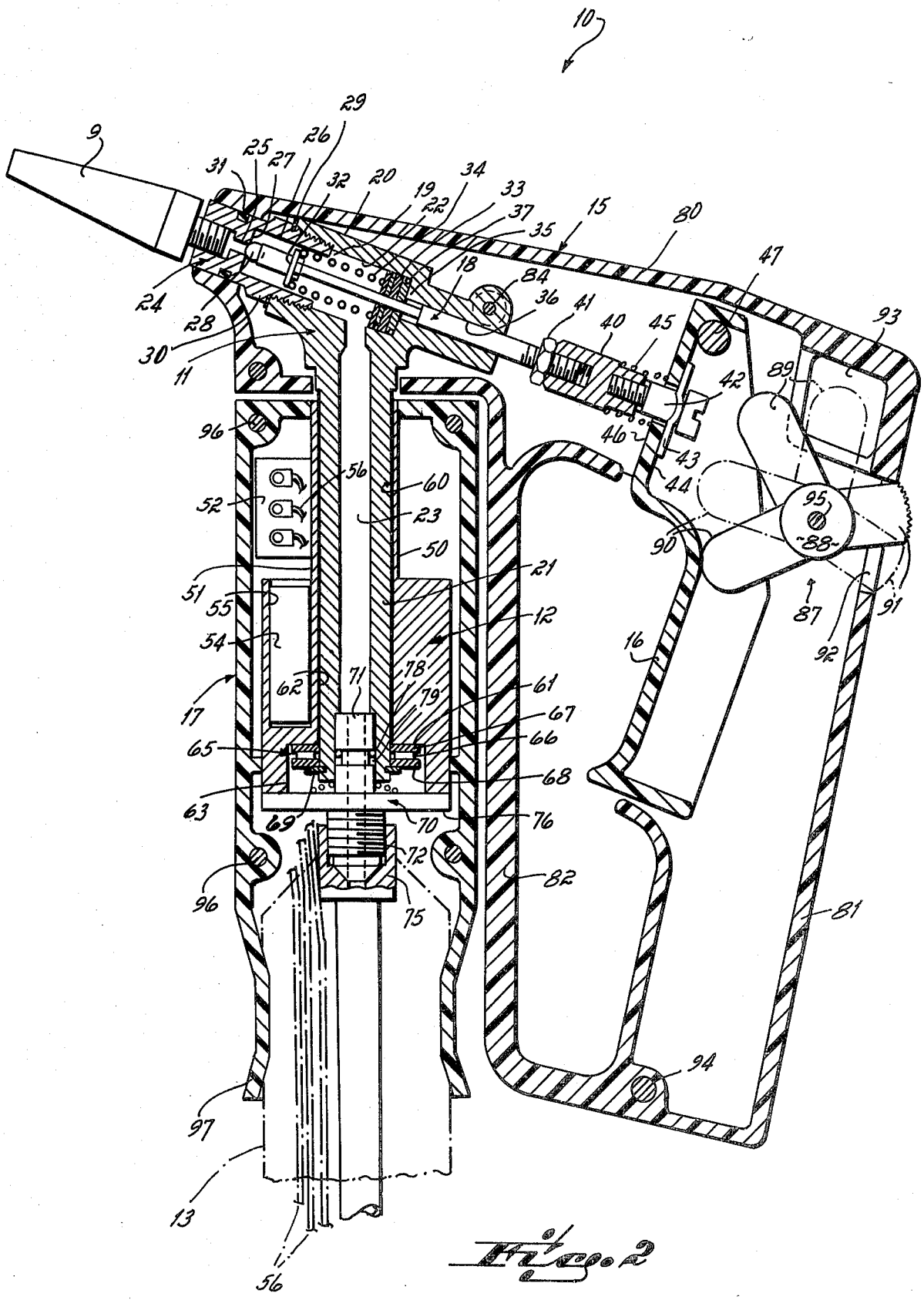
FIG. 2 is a cross-sectional view through the hand gun of FIG. 1.
Figure 3:
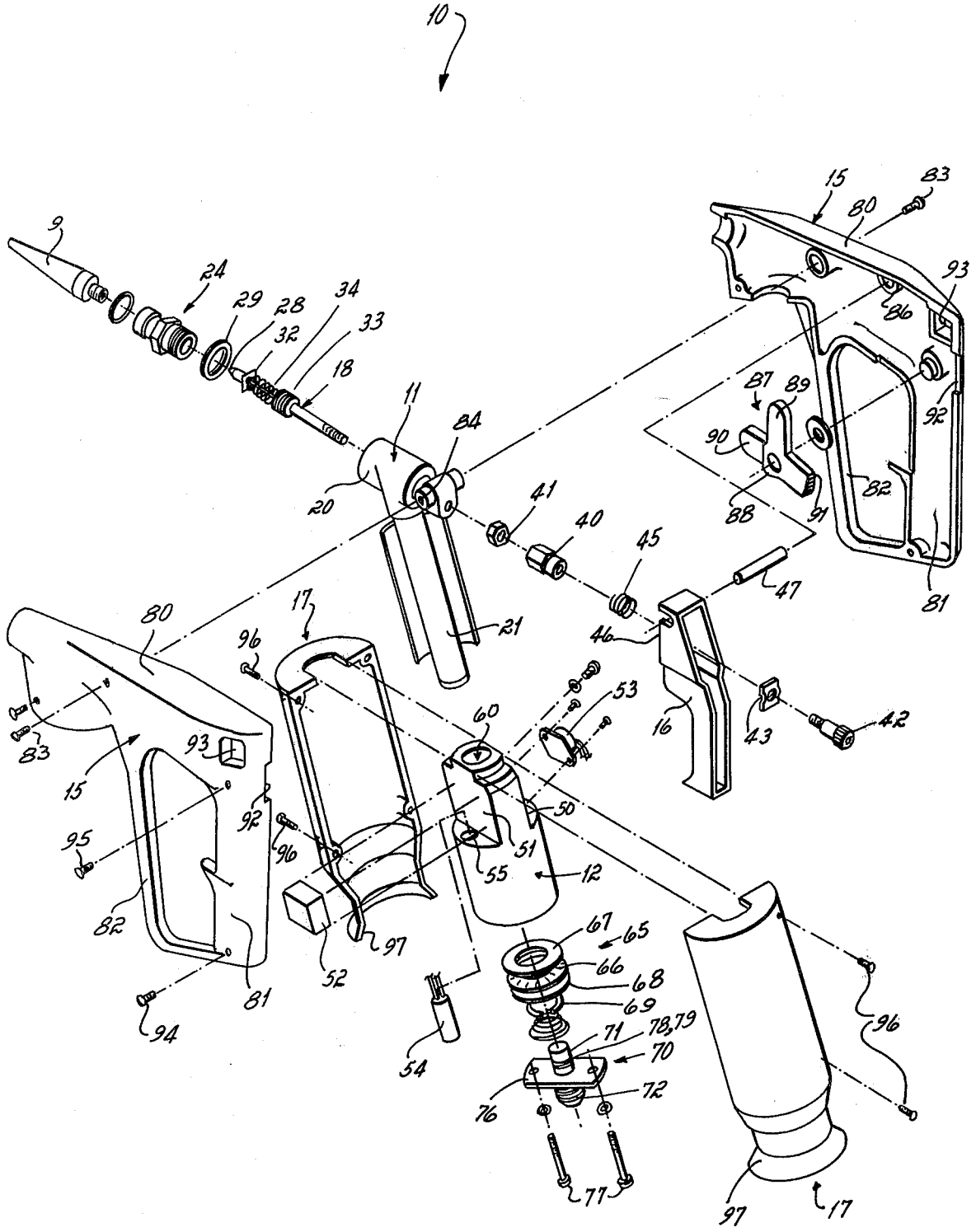
FIG. 3 is an exploded perspective view of the hand gun of FIG. 1.

The preferred embodiment of the invention of this application is illustrated in FIGS. 1–4. In general, this preferred embodiment of a dispensing gun 10 incorporating the invention of this application comprises a gun body 11 mounted within a heat transmitting metal pivot sleeve 12. This pivot sleeve 12 is fixedly secured to a heated flexible hose 13 through which molten adhesive and electrical power is supplied to the gun.

The gun body 11 is pivotable or rotatable relative to the pivot sleeve so that it may be directed toward a substrate or target without corresponding movement of the relatively stiff and heavy heated flexible hose 13. A plastic molded gun shell or housing 15 encloses the gun barrel portion 20 of the gun body. This housing includes a trigger 16 for controlling actuation of a valve contained internally of the gun body 11. The gun also includes a plastic molded shell 17 which encloses the heated pivot sleeve 12.

Mounted internally of the gun body 11 is a gun cartridge 19 which includes a valve operable to control flow of molten adhesive through the gun. At its rearwardmost end the gun cartridge is attached to the trigger 16 of the housing 15 such that actuation of the trigger 16 controls positioning of the valve and thus flow of molten adhesive from the gun.

In general, the gun body 11 comprises an upper barrel section 20 and a supporting post section 21. Preferably, the gun body is manufactured from a metal casting having an axial bore 22 extending through the barrel section and an intersecting axial bore 23 extending through the post section 21. These two bores intersect at an angle a of approximately 75°. The bore 22 of the gun barrel is internally threaded at its forwardmost end so as to threadedly receive the externally threaded rearward end of a valve seat 24. The valve seat 24 also has an axial bore extending therethrough, the forwardmost end of which is of a small diameter and the rearwardmost end of which is larger in diameter. Between the two different diameter sections 25 and 26 there is a shoulder 27, the inner edge of which is engageable by a ball 28 of the gun cartridge 19 to close the valve seat. A ring seal 29 is entrapped between the forwardmost end of the gun body 11 and a shoulder 30 of the valve seat so as to prevent leakage between the two. There is also preferably an O ring 31 surrounding the valve seat and engageable with the gun housing 15.

The gun cartridge 19 is a standard component of many prior art dispensing guns. In general, it comprises a valve stem 18 extending axially through the gun barrel and having the ball 28 mounted on its forward end. This stem 18 has a radial flange 32 extending outwardly at its forward end. Three sealing rings 33 are slidably mounted over the stem rearwardly of the flange. A compression spring 34 is operable between the flange and sealing rings to force the valve stem forwardly relative to the sealing rings 33, the rearwardmost one of which is engageable with a shoulder 35 formed on the interior of the gun body barrel between the larger diameter forwardmost section of the bore 22 and a smaller diameter rearward section 36. There is an external O ring seal 37 located between the rearwardmost sealing ring 33 and the shoulder 35. Additionally, there is an internal lip seal sandwiched between the forwardmost two of the sealing rings 33 and engageable with the external surface of the valve stem 18.

The rearward end of the valve stem 18 is externally threaded for reception of an internally threaded trigger linkage 40. A lock nut 41 secures the trigger linkage to the rearward end of the valve stem.

At its rearward end the trigger linkage 40 is bolted to the gun trigger 16 by a shoulder bolt 42. A bearing plate 43 is located between the head of the shoulder bolt and a flat rear surface 44 of the trigger. There is preferably a trigger spring 45 located between an external shoulder of the trigger linkage 40 and the forwardmost surface 46 of the trigger. The trigger 16 is pivotable relative to a pivot pin 47 so that it may be moved rearwardly from the position illustrated in FIG. 2 and in so moving, pull the bearing plate 43 rearwardly and with it the attached trigger linkage and valve stem.

The pivot post 21 of the gun body is rotatably mounted within the generally cylindrical metal pivot sleeve 12. This sleeve has a pair of flats 50, 51 formed on its upper end as may be best seen in FIG. 3. A ceramic connector 52 is located within one of these flats 51 and is fixedly secured to the sleeve by a conventional connector. The other flat 50 contains a thermostat 53 (FIG. 3) for controlling the temperature of the sleeve, and indirectly the temperature of the adhesive contained within the axial bore 23 of the gun body post 21. Heat is supplied to the pivot sleeve by a conventional electrical resistance heater 54 mounted within a bore 55 in the sleeve 17. Electrical power is supplied to ceramic connector 52 from an electrical lead 56 contained internally of the heated flexible housing 13. These contacts are also connected to the thermostat 53 and to the heater 54. A conventional electrical circuit illustrated in FIG. 4 controls flow of electrical power from the input lead 56 to heater 54 in accordance with the condition of the thermostat 53.

The pivot sleeve 12 has an axial bore 60 extending therethrough within which the gun body post 21 is mounted. This bore 60 is enlarged at its lower end so as to define a shoulder 61 between the smaller diameter upper section 62 and the larger diameter lower section 63. A thrust bearing 65 is operable between the lower end of the pivot sleeve 12 and the post 21 so as to permit free rotation of the post relative to the sleeve. This thrust bearing comprises a ball thrust bearing plate 66 located between a pair of bearing races 67, 68. A retaining ring 69 secures the bearing races and ball thrust bearing plate on the post 21. There is a swivel connector 70 fixedly attached to the lower end of the pivot sleeve 12. This swivel connector has an upper axial section 71 extending into the axial bore 23 of the gun pivot post and a lower threaded connector 72 threaded onto the transition fitting 75 of the heated flexible hose 13. Between these two sections 71 and 72 there is a swivel connector flange 76 bolted onto the lower end of the pivot sleeve by bolts 77. An O ring 78 and back-up ring 79 provide a seal between the bore 23 of the gun body and the swivel connector 70.

The heated flexible hose 13 is relatively heavy and torsionally non-rotatable. Consequently, the swivel connector 70 which is secured to the flexible hose is also relatively non-rotatable as is the pivot sleeve which is bolted to the swivel connector 70. Since the pivot sleeve does not rotate on the flexible hose 13, the electrical lead 56 through which electrical power is supplied from the flexible hose to the pivot sleeve does not rotate and there is no tendency for rotational movement of the gun to cause breakage or damage to that lead. Additionally, that lead, because it does not rotate or pivot upon rotational motion of the gun relative to the hose, does not inhibit rotational movement of the gun or in any way limit the rotational movement of the gun which may go through more than 360° because there is no problem with that electrical lead wrapping around the post or the gun as the gun is rotated.

The shell or housing which encases the gun body and the pivot sleeve comprises a two-piece plastic molded housing and a two-piece plastic pivot sleeve shell. The two pieces of the gun housing are very nearly mirror images of one another and similarly, the two pieces of the pivot sleeve shell are very nearly identical mirror images of one another. The trigger 16 is mounted between and pivotally supported from the two pieces of the molded gun housing.

The housing 15 in general comprises an upper portion 80 which surrounds the gun barrel and extends rearwardly from it, a handle section 81 which extends downwardly from the barrel section, and a trigger guard 82 which extends downwardly from the barrel section forwardly of the handle. At the forward end, the housing is secured to the gun body 11 by screws 83 which extend through apertures molded onto the barrel section of the housing and are threaded onto recesses 84 of the gun body. The trigger 16 is pivotally supported from the pivot pin 47 which extends between the two sections of the shell and is rotatably supported within a boss 86 molded onto each side of the shell.

At the rear end of the barrel section of the gun, a safety 87 is rotatably mounted between the two sections of the housing. This safety comprises a rotatable center section 88, or hub from which three arms or spokes extend outwardly, one arm 89 extending upwardly, a second arm 90 extending forwardly, and a third arm 91 extending rearwardly. The rearwardmost arm 91 extends through a slot 92 defined between the two halves of the gun housing so as to be exposed to movement by the gun operator's thumb. When arm 91 is pushed into its upwardmost position, it causes the forwardmost arm 90 to be moved into a position in which it blocks rearward movement of the trigger 16. Alternatively, the rear arm 91 may be moved by the operator to its lower position, shown in phantom lines in FIG. 2, in which the forwardmost arm 90 is in a non-blocking position relative to the trigger 16. The uppermost arm 89 serves as a telltale indication of the position of the safety. It is visible through a window 93 formed in the two halves of the gun housing when the gun is in the safety off condition. Thus, the gun operator is able to tell by the presence or absence of the arm 89 in the window 93 whether the gun safety is on or off. If the telltale arm 89 is visible, the safety is off and the gun is free for actuation of the trigger. In the operating condition, the operator cannot place the gun on a hook or otherwise leave the gun unattended; i.e., the arm 89 prevents the gun from being hung on a hook which would extend through window 93. Alternatively, if the telltale arm 89 is not present in the window the safety is on and the trigger cannot be pulled rearwardly to actuate the gun, and the operator may hang the gun on a hook which would extend through the window 93.

The two halves of the gun housing are maintained in assembled relation by screws 94 which extend through one-half of the gun housing and are threaded onto a threaded aperture in the other half. These screws, in addition to the screws 83 which attach the housing to the gun body, and the screw 95 which extends through the housing and through the gun safety 87 maintain the gun housing or gun shell in an assembled relationship.

The two-piece plastic shell 17 which surrounds the pivot sleeve primarily serves as an insulative barrier to protect the gun operator from the heated pivot sleeve. In the absence of the insulative shell, contact of an operator's hand or part of the operator's body with the pivot sleeve could cause a burn or injury. The two halves of the plastic shell are assembled over the pivot sleeve and attached one to the other by screws 96 which extend through unthreaded apertures molded in one-half of the sleeve shell and into threaded recesses in the other. Preferably, the shell extends downwardly below the level of the top of the heated flexible hose 13 so as to form a protective shield 97 over the upper end of the hose and particularly the connector between the hose and the gun.

In operation and with the gun 10 assembled to the heated flexible hose 13, gun operation is controlled by trigger 16. When the safety 87 is moved to an "off" position by the thumb of the operator, the trigger 16 may be actuated by squeezing of the handle 81, thereby causing the trigger to move rearwardly about the pivot pin 47. This rearward rotation of the trigger causes the trigger bearing plate 43 to be moved rearwardly, thereby pulling the attached valve stem 18 rearwardly and moving the ball 28 off of and out of contact with the valve seat 27. In this condition of the gun, pressurized fluid contained within the flexible hose 13 is free to flow upwardly through the gun body post 21 into and through the gun and out through the nozzle 9. When trigger 16 is released by the operator, the spring 34 contained within the gun cartridge causes the ball 28 of the gun cartridge to move to a closed position relative to valve seat 27 and thereby stop flow of adhesive from the hose upwardly and out through the nozzle.

The primary advantage of the gun described hereinabove resides in the fact that the gun heater does not rotate relative to the flexible hose even though the gun itself does rotate. Consequently, the electrical leads from the flexible hose to the gun heater do not rotate and therefore do not inhibit rotation of the gun relative to the flexible hose. Heretofore, in all of the hot melt dispensing guns of which we are aware, the electrical cord between heater and hose has rotated with the gun, thereby inhibiting gun movement and oftentimes being subjected to damage by rotation of the gun relative to the hose. Additionally, in prior art hose fed hand guns in which the heater and attached cord rotated with the gun, the electrical cord has restricted gun rotation to less than 360° of rotational movement. The gun described hereinabove is not subject to that restriction and may be rotated through multiple rotations in a single direction without the electrical cord in any way inhibiting gun movement.

While we have described only a single preferred embodiment of our invention, persons skilled in the art to which it pertains will appreciate numerous changes and modifications which may be made without departing from the scope of the invention. Therefore, we do not intend to be limited except by the scope of the following appended claims.

Having described our invention, we claim:

1. A hot melt hand gun for receiving molten adhesive under pressure from an adhesive source via a heated flexible hose and for dispensing that molten adhesive, said hand gun comprising a gun body defining a pair of intersecting tubular sections, a nozzle secured to one end of a first of said pair of gun body tubular sections for directing adhesive forwardly from the gun, valve means contained within said first body section for controlling flow from the nozzle, a housing including a handle and a trigger accessible to a hand grasping the handle for selectively opening the valve means, a second of said pair of tubular sections of said gun body being located in a common plane with the handle of said housing and being spaced forwardly of said handle, a heat transmitting pivot sleeve surrounding and extending for approximately the full length of said second tubular section of said gun body, said pivot sleeve being adapted to be fixedly secured to the heated flexible hose through which molten adhesive is supplied to said gun, an electrical heater mounted within said pivot sleeve, said heater being adapted to be electrically connected to an electrical lead in said flexible hose, and thrust bearing means operable between said pivot sleeve and said second tubular section of said gun body for enabling said gun body to be rotated about the axis of said pivot sleeve while said pivot sleeve and heater remain fixed relative to said flexible hose.

2. The hot melt hand gun of claim 1 in which said gun body is freely rotatable through more than 360° relative to said pivot sleeve.

3. The hot melt hand gun of claim 1 in which said thrust bearing means comprises a ball thrust bearing operable between a pair of bearing races, said races being spring biased into engagement with said ball thrust bearing.

4. The hot melt hand gun of claim 1 in which said pivot sleeve is manufactured from a heat transmitting metal, and further including a heat insulative shell surrounding and attached to said pivot sleeve.

5. A hot melt hand gun for receiving molten adhesive under pressure from an adhesive source via a heated flexible hose and for dispensing that molten adhesive, said hand gun being freely rotatable through multiple complete revolutions relative to said heated flexible hose and comprising, a gun body defining a pair of intersecting tubular sections, a nozzle secured to a first of said gun body sections for directing adhesive forwardly from the gun, valve means contained within said first body section for controlling flow from the nozzle, a housing including a handle and a trigger accessible to a hand grasping the handle for selectively opening the valve means, a second of said tubular sections of said gun body being located in a common plane with the handle of said housing and being spaced forwardly of said handle, a heat transmitting pivot sleeve surrounding said second tubular section of said gun body, said pivot sleeve being adapted to be fixedly secured to the heated flexible hose through which molten adhesive is supplied to said gun, an electrical heater mounted within said pivot sleeve, said heater being adapted to be electrically connected to an electrical lead in said flexible hose, and means mounting said hand gun for rotation through multiple full revolutions in one direction relative to said flexible hose, said hand gun mounting means comprising, thrust bearing means operable between said pivot sleeve and said second tubular section of said gun body for enabling said gun body to be rotated about the axis of said pivot sleeve while said pivot sleeve and heater remain fixed relative to said flexible hose.

6. The hot melt hand gun of claim 5 in which said thrust bearing means comprises a ball thrust bearing operable between a pair of bearing races, said races being spring biased into engagement with said ball thrust bearing.

7. The hot melt hand gun of claim 5 in which said pivot sleeve is manufactured from a heat transmitting metal, and further including a heat insulative shell surrounding and attached to said pivot sleeve.

8. A hot melt hand gun for receiving molten adhesive under pressure from an adhesive source via a heated flexible hose and for dispensing that molten adhesive, said hand gun comprising a gun body defining a barrel section and a pivot post section, said pivot post section defining a flow path between said barrel section and a heated flexible hose adapted to be secured to said pivot post section, a nozzle secured to one end of said barrel's section for directing adhesive forwardly from the gun, valve means contained within said gun body barrel section for controlling flow from the nozzle, a heat insulative housing surrounding said barrel section of said gun body, said housing including a handle and a trigger accessible to a hand grasping the handle for selectively opening the valve means, said handle section of said housing being located in a common plane with the pivot post section of said gun body, a heat transmitting pivot sleeve surrounding and extending for approximately the full length of said pivot post section of said gun body, said pivot sleeve being adapted to be fixedly secured to the heated flexible hose through which molten adhesive is supplied to said gun, an electrical heater mounted within said pivot sleeve, said heater being adapted to be electrically connected to an electrical lead in said flexible hose, bearing means operable between said pivot sleeve and said second tubular section of said gun body for enabling said gun body to be rotated about the axis of and relative to said pivot sleeve, and a heat insulative shell surrounding said pivot sleeve, said shell being mounted upon and fixed to said pivot sleeve.

9. The hot melt hand gun of claim 8 in which said gun body is freely rotatable through more than 360° relative to said pivot sleeve.

10. The hot melt hand gun of claim 8 in which said bearing means comprises a ball thrust bearing operable between a pair of bearing races.

11. The hot melt hand gun of claim 8 which further includes a safety for blocking movement of said trigger, said safety comprising a hub section, an actuating section, and a blocking section mounted upon said housing, said hub section being rotatably mounted upon said housing, said actuating section of said safety extending radially from said hub section outwardly beyond said housing so as to be exposed to actuation by the hand gun operator, and said blocking section extending radially from said hub section internally of said housing and being movable between a position in which it interferes with and prevents movement of said trigger and a non-interfering position depending upon the location of said actuating section of said safety.

12. The hot melt hand gun of claim 11 which further includes a window formed in said housing, said window being so located relative to said safety as to enable the position of said safety to be determined visually through said housing window.

13. A hot melt hand gun for dispensing molten adhesive, said hand gun comprising a gun body defining a barrel section, a nozzle secured to one end of said barrel's section for directing adhesive forwardly from the gun, valve means contained within said gun body barrel section for controlling flow from the nozzle, a heat insulative housing surrounding said barrel section of said gun body, said housing including a handle, a trigger accessible to a hand grasping the handle for selectively opening the valve means, a window opening formed in the opposite sides of said housing, said window opening being located at the rear of said housing above said handle and providing a hole through which a hook may be inserted to facilitate said gun being suspended from the hook, and safety means movably mounted within said housing, said safety means being movable to a position in which it interferes with and prevents movement of said trigger and a non-interfering position in which it permits said trigger to be actuated and open said valve means, said safety means further including a tell-tale section movable into and out of said window opening of said housing to indicate the position of said safety means, said tell-tale section being operative to block said window opening and to prevent said gun from being suspended from a hook when said safety means is in a non-interfering position relative to said trigger.

14. The hot melt hand gun of claim 13 wherein said safety means comprise a hub section, an actuating section, and a blocking section in addition to said tell-tale section, said hub section being rotatably mounted within said housing, said actuating section of said safety extending radially from said hub section outwardly beyond said housing so as to be exposed to actuation by the hand gun operator, and said blocking section extending radially from said hub section internally of said housing and being movable between a position in which it interferes with and prevents movement of said trigger and a non-interfering position relative to said trigger depending upon the location of said actuating section of said safety.

* * * * *